US008678301B2

(12) United States Patent
Hubbard

(10) Patent No.: US 8,678,301 B2
(45) Date of Patent: Mar. 25, 2014

(54) STEPPED SWIRLER FOR DYNAMIC CONTROL

(75) Inventor: Phillip Hubbard, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/119,476

(22) PCT Filed: Aug. 5, 2009

(86) PCT No.: PCT/EP2009/060144

§ 371 (c)(1), (2), (4) Date: Mar. 17, 2011

(87) PCT Pub. No.: WO2010/034558

PCT Pub. Date: Apr. 1, 2010

(65) Prior Publication Data

US 2011/0168801 A1 Jul. 14, 2011

(30) Foreign Application Priority Data

Sep. 25, 2008 (EP) ..... 08016915

(51) Int. Cl.

| | |
|---|---|
| ***B05B 1/34*** | (2006.01) |
| ***B05B 7/10*** | (2006.01) |
| ***F02C 1/00*** | (2006.01) |
| ***F02G 3/00*** | (2006.01) |

(52) U.S. Cl.

USPC ..... 239/468; 239/403; 60/748

(58) Field of Classification Search

USPC ..... 239/461, 463, 466, 467, 468, 398, 399, 239/402, 403, 404, 432, 533.12, 533.14; 60/748

See application file for complete search history.

(56) References Cited

U.S. PATENT DOCUMENTS

| | | | | |
|---|---|---|---|---|
| 4,271,675 | A | 6/1981 | Jones | |
| 5,353,599 | A | 10/1994 | Johnson et al. | |
| 5,450,724 | A * | 9/1995 | Kesseli et al. | 60/737 |
| 5,941,075 | A * | 8/1999 | Ansart et al. | 60/748 |
| 6,532,726 | B2 * | 3/2003 | Norster et al. | 60/39.281 |
| 7,065,972 | B2 * | 6/2006 | Zupanc et al. | 60/748 |
| 2004/0211186 | A1 | 10/2004 | Carella et al. | |
| 2007/0028624 | A1 | 2/2007 | Hsiao | |

FOREIGN PATENT DOCUMENTS

| | | | |
|---|---|---|---|
| EP | 0722065 | A2 | 7/1996 |
| EP | 0957311 | A2 | 11/1999 |
| EP | 1647772 | A1 | 4/2006 |
| EP | 1710502 | A2 | 10/2006 |
| EP | 1867925 | A1 | 12/2007 |
| EP | 1890083 | A1 | 2/2008 |
| EP | 1918638 | A1 | 5/2008 |
| GB | 2272756 | A | 5/1994 |
| SU | 1430685 | A1 | 10/1988 |
| WO | WO 03014620 | A1 | 2/2003 |
| WO | WO 2007131818 | A1 | 11/2007 |

* cited by examiner

*Primary Examiner* — Justin Jonaitis

(57) ABSTRACT

A swirling device for injecting a medium into a turbine is provided. The swirling device includes a central axis, a central passage in an axial direction along the central axis and an outer perimeter. The swirling device further includes a first duct and a second duct. The first duct and the second duct are adapted for guiding the medium from a region surrounding the outer perimeter to the central passage. The first duct includes a first depth in the axial direction and the second duct includes a second depth in the axial direction. The first depth and the second depth are different.

12 Claims, 2 Drawing Sheets

STEPPED SWIRLER FOR DYNAMIC CONTROL

CROSS REFERENCE TO RELATED APPLICATIONS

This application is the US National Stage of International Application No. PCT/EP2009/060144, filed Aug. 5, 2009 and claims the benefit thereof. The International Application claims the benefits of European Patent Office application No. 08016915.4 EP filed Sep. 25, 2008. All of the applications are incorporated by reference herein in their entirety.

FIELD OF INVENTION

The present invention relates to the field of fuel injectors for gas turbine engines. In particular, the present invention relates to a swirling device for injecting a medium into a turbine. Moreover, the present invention relates to a method of injecting a medium into a turbine.

ART BACKGROUND

In order to provide turbines a more efficient gas turbine there may be a need to reduce high levels of fluid dynamic during injection of a gas/fuel mixture into a combustion system of a turbine. While running on liquid fuel, the combustion system produces high levels of combustion dynamics, such as pressure changes of a fuel, changes in the flow direction of the fuel air mixture and flame dynamics, which may cause over a period of time fretting or component failure.

In conventional systems this problem has been solved in two ways. Firstly, a series of small holes may be provided in a flame tube of the combustion system to give the best compromise between cooling the flame tube wall and providing an air film over the components in order to protect the same from fretting. This barrier of cooling air may also provide acoustic damping. Secondly, a fuel to air ratio between the main burner and the pilot burner may be varied in order to reduce the dynamics.

EP 0722065 A2 discloses a fuel injector arrangement for gas- or liquid-fuels turbines. The arrangement comprises means for producing at least one air stream for mixing with a supply of fuel but wherein the supply of fuel is initially injected into at least one zone adjacent an air stream but shielded therefrom. Thereby, fuel rich pockets of fluid are formed in these zones. The pockets ensure flame stability at least at lower power settings. The zone is defined by a wall of a swirler. The fuel is injected through nozzles and additional nozzles for a supplementary supply of fuel may be provided in a block.

EP 0957311 A2 discloses a gas-turbine engine combustor. A lean burn combustor of a gas-turbine engine has a radial inflow pre-mixing, pre-swirling burner with a central burner face which forms an upstream wall of a pre-chamber of the combustor. A circular recess is faulted in the burner face. The recess comprises at least one pilot fuel injector for introducing pilot fuel tangentially into the recess.

EP 1 890 083 A1 discloses a fuel injector for a gas-turbine engine. A ring-shaped fuel injector comprises an inner diameter and an outer diameter. Furthermore, the ring-shaped fuel injector comprises a fuel groove arranged in a face side of the ring and at least one fuel injection opening is arranged on the ring and is connected to the fuel groove.

EP 1 867 925 A1 discloses a burner, in particular a gas turbine burner. A swirler of the burner comprises at least one air inlet opening, at least one air outlet opening that is positioned downstream to the air inlet opening and at least one swirler air passage extended from the at least one air inlet opening to the at least one air outlet opening which is delimited by swirler air passage walls. At least the downstream section of one air passage wall is thereby conjugated.

U.S. Pat. No. 5,941,075 discloses a fuel injection system with improved air/fuel homogenization. The system is adapted for injecting air and fuel into a combustion chamber of a turbojet engine. A housing is located rearwardly of a first radial swirler and forming a pre-mixing chamber bound by a conversion/diversion wall forming a venturi with a throat. The housing having a plurality of second air passages forming a second radial swirler to direct air into the pre-mixing chamber forward of the venturi throat in a second plane generally perpendicular to the axis A. Thereby, the second passages and the third passages alternating in a circumferential direction around the housing.

SUMMARY OF THE INVENTION

It may be an object of the invention to provide a resistant fuel injection system for a turbine.

In order to achieve the object defined above, a swirling device for injecting a medium into a turbine and a method of injecting a medium into a turbine according to the independent claims are provided.

According to a first exemplary embodiment of the invention, a swirling device for injecting a medium into a turbine is described. The swirling device comprises a centre axis, a central passage in an axial direction along the centre axis and an outer perimeter. The swirling device further comprises a first duct and a second duct. The first duct and the second duct are adapted for guiding the medium from a region surrounding the outer perimeter to the central passage. The first duct comprises a first depth in the axial direction and the second duct comprises a second depth in the axial direction. The first depth and the second depth are thereby different.

According to a further exemplary embodiment, a method of injecting a medium into a turbine is provided. A medium is guided from a region surrounding an outer perimeter to a central passage of the swirling device by a first duct and a second duct. A first depth of the first duct in an axial direction of the swirling device is provided and a second depth of the second duct in the axial direction of the swirling device is provided. The first depth and the second depth are provided differently.

The swirling device may comprise a plate shape element with a circular, elliptical or polygonal shape and may comprise furthermore a passage or a bore hole around the centre axis for guiding a medium therethrough. The centre axis may be similar to a symmetry axis of the swirling device.

The first and second ducts may be provided by slots that may be milled into a face surface of the swirling device. The ducts may also be provided by swirler vanes that are attached to the swirling device. The swirler vanes may be in one exemplary embodiment be changeable or adjustable so that a width or a depth of the first and second ducts may be changeable or adjustable.

The first depth and the second depth of the first and second ducts are defined with respect to the axial direction along the centre axis. In other words, the base area of the first duct and the base area of the second duct define a first plane and a second plane. The first plane of the base area of the first duct and the second plane of the base area of the second duct are provided perpendicular to the centre axis. Thus, an intersection of the first plane of the base area of the first duct with the centre axis is different with respect to the intersection of the second plane of the ground area of the second duct with the centre axis, i.e., the duct depth of the first ducts and the depth of the second ducts are different, so that e.g. a medium that streams through the first and the second ducts exits the duct into the central passage at a different height with respect to the centre axis of the swirling device.

In conventional systems, it may be tried to produce a homogeneous exhaustion of a mixture of air and fuel by using ducts or passages each comprising similar and fixed dimension. With the claimed invention, the depth of the first duct and the second duct may be different which will have the effect of altering the exhaust of a medium between each of the ducts and thus within the central passage. This may also alter the burning characteristic which produces a smaller area of flame which furthermore may burn with a lower level of noise. The reduced combustion dynamics leading to improved component life.

Because the medium that flows through the first duct may exit the first duct into the passage in a different height with respect to the medium that flows through the second duct, the flow pattern of the medium that flows through the first ducts and the second ducts is inhomogeneous and may thereby provide a disturbance in the flow pattern of the swirler device, in particular the flow pattern in the central passage. This desired disturbance in the flow pattern in the central passage of the swirler device leads to a mitigating effect of a pressure oscillation in a combustion system to which the swirling device may be arranged. In conventional systems it may be attempt to keep the flow pattern homogeneous. By providing a homogeneous flow pattern there may be a risk that a resonance frequency of the pressure oscillation of a medium will be met so that the pressure oscillation may be increased dramatically which may cause fretting or component failures. By the present invention, the flow pattern of the medium that flows from the ducts into the central passage is inhomogeneous. Thus, by the inhomogeneous flow pattern of the medium an increase of the pressure oscillation may be prevented due to reducing the risk of providing a resonance frequency of the pressure oscillation in the combustion system, in particular in the central passage of the swirling device.

The first duct and the second duct may be provided around the inner surface of the central passage. Furthermore, the base area of the first duct and the base area of the second duct may be constant or plane, i.e. the base area of the first duct and the second duct may not need any steps in order to provide a disturbance in the flow pattern. The disturbance in the flow pattern will be provided by the first depth of the first duct and the second depth of the second duct so that the medium that flows through the first duct and the second duct exits in the area of the centre passage in a different height with respect to the central axis and thereby providing an inhomogeneous flow pattern, i.e. a disturbance in the flow pattern.

The term "medium" may describe a fluid in a liquid state or a gaseous state. The medium may also provide a mixture of a liquid fluid and a gaseous fluid. The liquid fluid may be for instance a combustible fluid or fuel, such as kerosene, gasoline or diesel. The gaseous fluid may comprise for instance a hydrogenous or an oxygen containing fluid, such as air, or oxygen. The mixture of liquid fluid and gaseous fluid may be for instance an air fuel mixture.

According to a further exemplary embodiment, the first duct and the second duct are adapted for guiding the medium tangential to an inner surface of the central passage. Thus, the medium may injected tangential, i.e. parallel to the inner surface of the passage, so that a swirl of the medium around the centre axis may be provided. Thus, a better flame characteristic and a further mitigation of the pressure oscillation may be provided. Furthermore, a mixture, for instance of liquid fluid and gaseous fluid, may be improved.

According to a further exemplary embodiment, at least one of the first duct and the second duct comprise a gas injection portion. The gas injection portion is adapted for injecting a gaseous medium from a region surrounding the outer perimeter to the central passage. The gas injection portion may be located at the outer perimeter so that air or other gaseous medium may be provided to the first and second ducts. Furthermore, the gas injection portion may comprise an injection hole in the base area or in the sidewalls of the first and the second ducts, wherein the gaseous fluid may be injected therethrough. To the gas injection portion, in particular to the hole, a nozzle may be inserted, so that a desired high pressure gaseous fluid may be injected to the first and the second ducts.

According to a further exemplary embodiment, the first duct comprises a liquid injection portion for injecting a liquid medium. The liquid injection portion is located between the gas injection portion and the central passage. The gas injection portion may also be located in the base area or the sidewalls of the first duct. The liquid injection portion may be placed in the flow direction of the medium behind the gas injection portion, i.e. between the gas injection portion and the inner surface of the swirling device. Thus, the gaseous fluid that may be already injected by the gaseous injection portion may be mixed with the liquid fuel so that for instance an air fuel ratio with a good and homogeneous mixture may be provided to the central passage. To the holes of the liquid injection portion nozzles may be attached so that the liquid fluid may be injected with a predetermined pressure and direction.

According to a further exemplary embodiment the swirling device further comprises at least a further first duct, wherein the further first duct comprises a further first depth that is different to the first depth of the first duct. With this exemplary embodiment, not only a first depth of a first duct and a second depth of the second duct may be varying or may be different but also the first depth and the further first depth between a plurality of the first ducts and of the further first ducts may be varying so that the disturbance in the flow pattern of the swirler may be increased and thus the mitigating effect on the pressure oscillation may be improved.

According to a further exemplary embodiment, the swirling device comprises at least a further second duct, wherein the further second duct comprises a further second depth that is different to the second depth of the second duct. Thus, the second ducts or the further second ducts may comprise a different depth so that a disturbance in the flow pattern of the swirler may be increased.

According to a further exemplary embodiment, the first ducts and the second ducts are alternately located in circumferential direction around the swirling device. Thus, it may be possible to locate alternately a second duct next to a first duct. Thus, an air/fuel ratio and a gaseous fluid steaming out from the first duct and the second duct into the central passage may be mixed. Additionally, in order to provide different flow patterns of the central passage, for instance two first ducts may be located next to each other and be placed between one second duct. Furthermore, two second ducts may be located next to each other and be placed between one first duct, as well.

According to a further exemplary embodiment, the width of at least one of the first ducts and the second ducts is adapted to be constant. Thus, the pressure of the medium steaming through the first duct and the second duct may be kept constant in the first duct and/or the second duct due to the constant width.

According to a further exemplary embodiment, the width of at least one of the first ducts and the second ducts is adapted to be decreased in the direction from the region surrounding the outer perimeter to the central passage. Thus, the pressure and the velocity of the medium steaming through the first duct and/or the second duct may be increased by reducing or decreasing the width in the direction to the central passage. Therefore, a desired flow pattern in the central passage may be provided.

According to a further exemplary embodiment, the swirling device further comprises a control unit. The control unit is adapted for controlling the medium volume and pressure in at least one of the first ducts and the second ducts. The control unit may for instance control the medium volume and the medium pressure that is injected by the liquid injection portion or the gas injection portion. Furthermore, the control unit may control the width and the depth of the first ducts and the second ducts. For instance, in one exemplary embodiment, the first ducts and the second ducts may be formed by swirler vanes that may be adjustable placed to the swirling device. Thus, by moving the swirler vanes, a desired width and/or a desired depth of the first and second ducts may be provided. Hence, the control unit may adjust a desired flow pattern of the medium in the swirling device, in particular in the central passage.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless otherwise notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

BRIEF DESCRIPTION OF THE DRAWINGS

The invention will be described in more detail hereinafter with reference to examples of embodiments but to which the invention is not limited.

DETAILED DESCRIPTION

Figure 1:
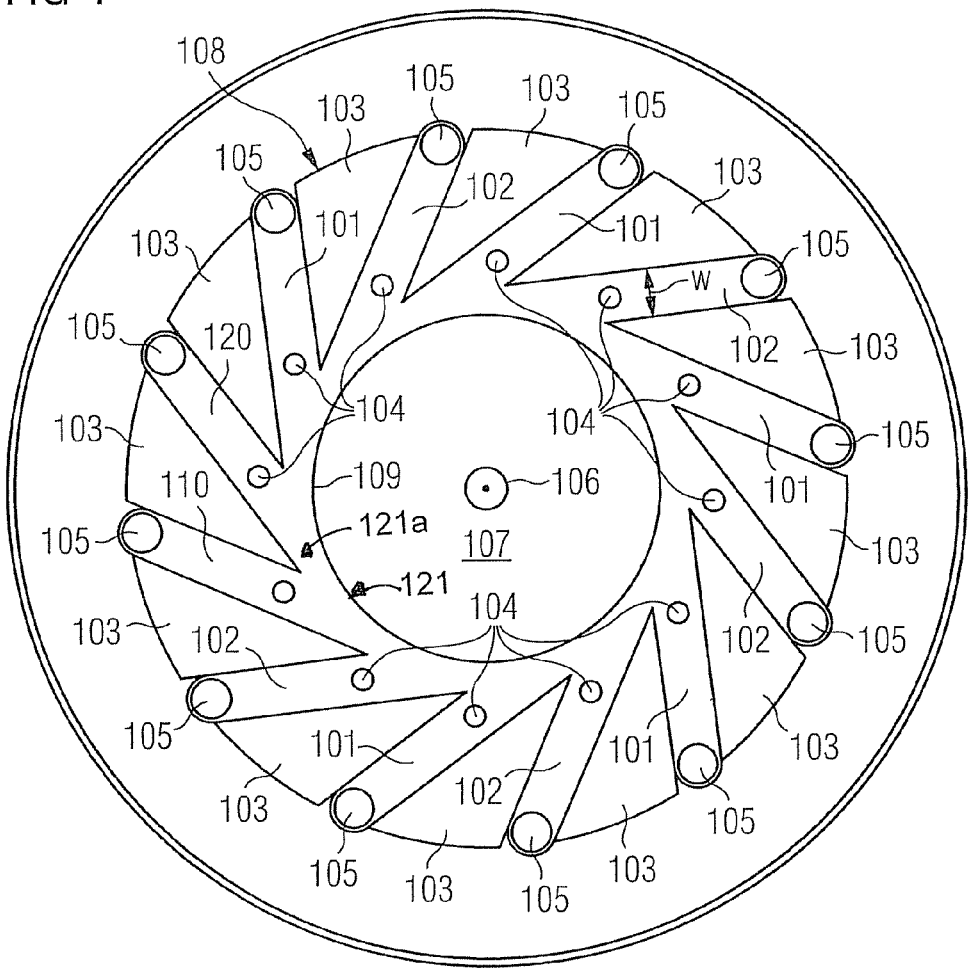
FIG. 1 illustrates a top view of the swirling device according to an exemplary embodiment of the invention.

The illustration in the drawing is schematically. It is noted that in different figures, similar or identical elements are provided with the same reference signs or with reference signs, which are different from the corresponding reference signs only within the first digit.

FIG. 1 shows a swirling device 100 for injecting a medium into a turbine. The swirling device 100 comprises a central axis 106, a central passage 107 in an axial direction along the centre axis 106 and an outer perimeter 108. The swirling device 100 further comprises a first duct 101 and a second duct 102. The first duct 101 and the second duct 102 are adapted for guiding the medium from a region surrounding the outer perimeter 108 to the central passage 107. The first duct 101 comprises a first depth $d_1$ in the axial direction and the second duct 102 comprises a second depth $d_2$ in the axial direction. The first depth $d_1$ and the second depth $d_2$ are different.

Furthermore, FIG. 1 shows a swirling device 100 that comprises a circular shape, wherein the swirling device 100 is for instance made of a circular plate-like material. In the centre of the swirling device 100 a centre axis 106, i.e. a symmetrical axis, is provided. The swirling device 100 furthermore comprises a central passage 107 that is located around the centre axis 106. Through the central passage 107, the injected medium that flows through the first duct 101 and the second duct 102 may be forwarded to a main burner chamber or a pilot burner chamber for combustion. The swirling device 100 furthermore comprises an outer perimeter 108, from which a medium may be provided from a region surrounding the outer perimeter 108 to the first duct 101 and the second duct 102.

In the exemplary embodiment of FIG. 1, the first duct 101 and the second duct 102 comprise a gas injection portion 105. The gas injection portion may provide gaseous medium to the first and the second ducts. The gaseous injection portion 106 may supply gaseous medium from the region surrounding the outer perimeter 108 or may supply gaseous medium through a hole in a base area of the first ducts 101 or the second ducts 102.

The first ducts furthermore may provide a liquid injection portion 104. As seen in FIG. 1, the liquid injection portion 104 may be located in the first duct 101 between the inner surface 109 of the central passage 107 and the outer perimeter 108. Through the liquid injection portion 104 a liquid medium, such as fuel, may be injected in the direction to the central passage 107.

As can be seen from FIG. 1, the first and the second ducts 101, 102 may direct the flow of a medium in a tangential direction to the inner surface 109 of the central passage 107. For this reason, the medium that is injected to the central passage 107 comprises a swirl flow around the inner surface 109 so that a better flow pattern of the swirler may be provided.

Furthermore, as can be seen from FIG. 1, the first duct 101 and the second ducts 102 may be built up by swirler vanes 103. The swirler vanes 103 may be attached to the swirling device 100 and therefore define a certain width w and a certain depth $d_1$, $d_2$, $d_{10}$ or $d_{20}$ of the first duct 101 and the second duct 102, as well as for the further first ducts 110 and the further second ducts 120.

Furthermore, as can be seen from FIG. 1, the first ducts 101 and the second ducts 102 are located next to each other i.e. the first ducts 101 and the second ducts 102 are alternately located around the perimeter of the swirling device 100.

Furthermore, as can be seen from FIG. 1, some ducts are marked as further first ducts 110 and further second ducts 120. The further first ducts 110 and the further second ducts 120 may provide similar characteristics as the first ducts 101 and the second ducts 102. The further first ducts 110 and the further second ducts 120 may vary in the first depth $d_1$ and the second depth $d_2$, i.e., the further first duct 110 comprises a further first depth $d_{10}$ that may be different to the first depth $d_1$ of the first duct 101. The further second depth $d_{20}$ of the further second duct 120 may be different to the second depth $d_2$ to the second duct 102.

Figure 2:
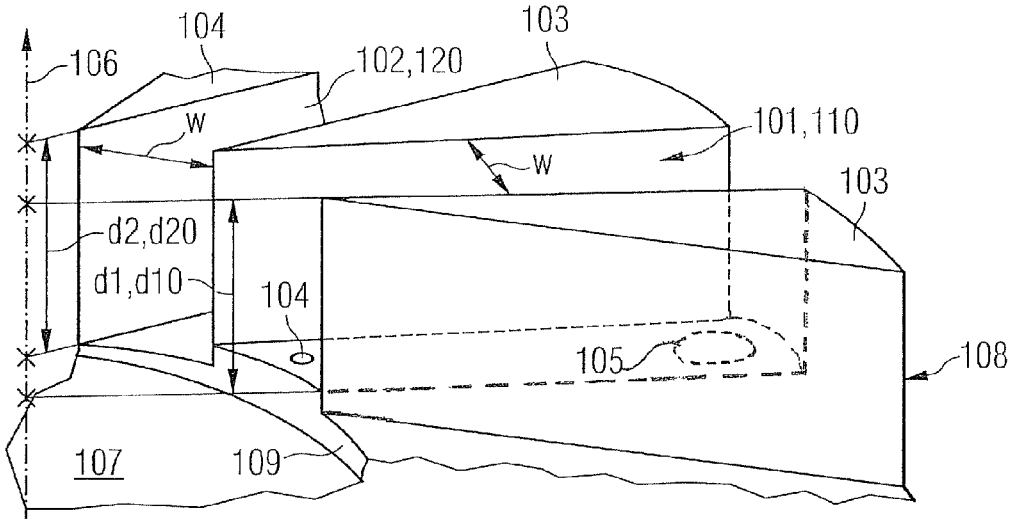
FIG. 2 illustrates a respective view of the exemplary embodiment of FIG. 1.

FIG. 2 illustrates a perspective view of the swirling device 100 wherein the differences of the first depth $d_1$, $d_{10}$ and the second depths $d_2$, $d_{20}$ are shown. In vertical direction the direction of the centre axis 106 of the swirling device 100 is shown. Furthermore, swirler vanes 103 are shown that builds up the first duct 101, the further first duct 110, the second duct 102 and the further second duct 120. The first ducts 101, 110 and the second ducts 102, 120 may be formed from the outer perimeter 108 to the inner surface 109 of the swirling device 100. As shown in FIG. 2, the first ducts 101, 110 comprise the liquid injection portion 104 and the gas injection portion 105. Each of the first ducts and the second ducts comprise a width w which may be constant in the exemplary embodiment shown in FIG. 2.

Furthermore, FIG. 2 illustrates the different depths of the first ducts 101, 110 and the second ducts 102, 120. As can be seen from FIG. 2, the first depths $d_1$, $d_{10}$ are different to the second depths $d_2$, $d_{20}$. This may be made more clear by comparing the ground areas 122 and 123 of the first ducts 110, 101 and the second ducts 102, 120 respectively, which comprise a different height as shown in FIG. 2. With other words, the ground area 122 of the first ducts 101, 110 defines a horizontal plane that is perpendicular to the central axis 106. The intersection of the vertical plane of the ground area 122 of the first duct builds a starting point for measuring the first depth $d_1$, $d_{10}$ along the axial direction of the central axis 106. The first depth may be measured till the upper end of the first ducts 101. Similarly, the second depth $d_2$, $d_{20}$ may be defined. The second ducts 102, 120 may comprise a ground area 123 that defines a second horizontal plane that is perpendicular to the central axis 106. From the intersection point of the second plane with the central axis 106, the second depth $d_2$, $d_{20}$ may be measured till the upper end of the second ducts 102, 120.

As shown in FIG. 2, the first ducts and the second ducts comprise different depths. I.e., the first depths $d_1$, $d_{10}$ and the second depths $d_2$, $d_{20}$ may be different to each other. Thus, a medium that flows from the outer perimeter 108 to the central passage 107 exits the ducts at different heights with respect to the central axis 106. Therefore, a disturbance in the flow pattern of the swirling device 100 is created which will have a mitigating effect on pressure oscillations in the whole combustion system.

The different depths $d_1$, $d_2$, $d_{10}$, $d_{20}$ may be provided by a ground plate 121 with a face surface 121*a* that comprises a different thickness of its material, e.g. formed by slots or grooves, as shown in FIG. 2, for instance.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A swirling device for injecting a medium into a turbine, comprising:

a center axis;

a central passage in an axial direction along the center axis;

an outer perimeter; and a ground plate with a face surface in which a plurality of grooves are milled to form a first duct and a second duct, wherein the first duct and the second duct are adapted for guiding the medium from a region surrounding the outer perimeter to the central passage, wherein the first duct comprises a first ground area extending from a radially inner end to a radially outer end of the first duct, the first ground area defining a lying entirely within a first plane that is perpendicular to the center axis, wherein the second duct comprises a second ground area extending from a radially inner end to a radially outer end of the second duct, the second ground area lying entirely within a second plane that is perpendicular to the center axis, wherein the first duct further comprises a first depth in the axial direction and the second duct further comprises a second depth in the axial direction, wherein the first depth is measured from the first ground area to an upper end of the first duct and the second depth is measured from the second ground area to an upper end of the second duct, wherein the first depth and the second depth are different from each other, and wherein the first depth and second depth are provided by a different material thickness of the ground plate.

2. The swirling device according to claim 1, wherein at least one of the first duct and the second duct are adapted for guiding the medium tangential to an inner surface of the central passage.

3. The swirling device according to claim 1, wherein at least one of the first duct and the second duct comprise a gas injection portion, and wherein the gas injection portion is adapted for injecting a gaseous medium from the region surrounding the outer perimeter to the central passage.

4. The swirling device according to claim 3, wherein the first duct comprises a liquid injection portion for injecting a liquid medium, and wherein the liquid injection portion is located between the gas injection portion and the central passage.

5. The swirling device according to claim 1, wherein a plurality of first ducts and a plurality of second ducts are alternately located in a circumferential direction around the swirling device.

6. The swirling device according to claim 1, wherein a width of at least one of the first duct and the second duct is constant from the region surrounding the outer perimeter to the central passage.

7. A method of injecting a medium into a turbine, the method comprising:

guiding a medium from a region surrounding an outer perimeter to a central passage of a swirling device, wherein the swirling device comprises:

a center axis, a central passage in an axial direction along the center axis, an outer perimeter, and a ground plate with a face surface in which a plurality of grooves are milled to form a first duct and a second duct, wherein the first duct and the second duct are adapted for guiding the medium from a region surrounding the outer perimeter to the central passage, wherein the first duct comprises a first ground area extending from a radially inner end to a radially outer end of the first duct, the first ground area lying entirely within a first plane that is perpendicular to the center axis, wherein the second duct comprises a second ground area extending from a radially inner end to a radially outer end of the second duct, the second ground area lying entirely within a second plane that is perpendicular to the center axis, wherein the first duct further comprises a first depth in the axial direction and the second duct further comprises a second depth in the axial direction, wherein the first depth is measured from the first ground area to an upper end of the first duct and the second depth is measured from the second ground area to an upper end of the second duct, wherein the first depth and the second depth are different from each other, and wherein the first depth and second depth are provided by a different material thickness of the ground plate.

8. The method according to claim 7, wherein at least one of the first duct and the second duct are adapted for guiding the medium tangential to an inner surface of the central passage.

9. The method according to claim 7, wherein at least one of the first duct and the second duct comprise a gas injection portion, and wherein the gas injection portion is adapted for injecting a gaseous medium from the region surrounding the outer perimeter to the central passage.

10. The method according to claim 9, wherein the first duct comprises a liquid injection portion for injecting a liquid medium, and wherein the liquid injection portion is located between the gas injection portion and the central passage.

11. The method according to claim 7, wherein a plurality of first ducts and a plurality of second ducts are alternately located in a circumferential direction around the swirling device.

12. The method according to claim 7, wherein a width of at least one of the first duct and the second duct is constant from the region surrounding the outer perimeter to the central passage.

* * * * *